United States Patent [19]

Hsu

[11] 4,002,281

[45] Jan. 11, 1977

[54] MULTI-PURPOSE STAPLER

[75] Inventor: Sheau-Po Hsu, Hu Wei Town, China /Taiwan

[73] Assignee: Eic International Corporation, Taipei, China /Taiwan

[22] Filed: Dec. 4, 1975

[21] Appl. No.: 637,663

[52] U.S. Cl. ..... 227/63; 227/76

[51] Int. Cl.[2] ..... B25C 11/00

[58] Field of Search ..... 227/63, 76

[56] References Cited

UNITED STATES PATENTS

| | | | |
|---|---|---|---|
| 2,102,087 | 12/1937 | Pankonin | 227/63 |
| 2,499,432 | 3/1950 | Von Cseh | 227/63 |
| 3,907,190 | 9/1975 | Mitsuhashi | 227/76 |

FOREIGN PATENTS OR APPLICATIONS

| | | | |
|---|---|---|---|
| 821,189 | 11/1951 | Germany | 227/76 |

*Primary Examiner*—Granville Y. Custer, Jr.
*Attorney, Agent, or Firm*—Burns, Doane, Swecker & Mathis

[57] ABSTRACT

A multi-purpose stapler is provided comprising a hole punching means, a stapler removing means and a stapling means mounted on a common base.

3 Claims, 2 Drawing Figures

MULTI-PURPOSE STAPLER

FIELD OF THE INVENTION

The present invention relates generally to a stapler and more particularly to a multi-purpose stapler comprising a stapler with a shiftable stapling blade, a staple clinching die, a pinchers type staple remover and a hole punch all disposed on a common base and operable with the same handle. When the stapling blade is shifted forward to a suspension position, either staple remover or hole punch is capable of serving its respective purpose.

BACKGROUND OF THE INVENTION

A stapler, hole punch and staple remover are necessary items for office work. Such items individually would occupy substantial desk space. Therefore, a multi-purpose item that can perform all these functions is desirable to eliminate such shortcomings. A Chinese Pat. No. 22373 was granted to the present inventor for a stapler with a hole punch mounted on the side of the stapler which is not economical from a manufacturer's point of view. Further, a staple remover also provided thereon was clumsy and inconvenient to use. Thus, there is still a need for an improved multi-purpose stapler.

SUMMARY OF INVENTION

Therefore, a main object of the present invention is to provide a novel multi-purpose stapler having a hole punch located under the rear center of the stapler and a staple remover at the front most portion of the stapler. When a shiftable stapling blade is moved forward to a suspension position, either staple remover or hole punch is capable of serving its respective purpose.

Another object of the present invention is to provide a multi-purpose stapler wherein the staple removing function is accomplished with a pair of pinchers which are actuated by the press handle of the stapler.

Still another object of the present invention is to provide a multi-purpose stapler which is so disposed as to provide a compact construction without occupying substantial desk space.

Other objects and features of the present invention will become apparent from the following detailed description to be taken in conjunction with the annexed drawings.

DETAILED DESCRIPTION OF PREFERRED EMBODIMENT

Figure 1:
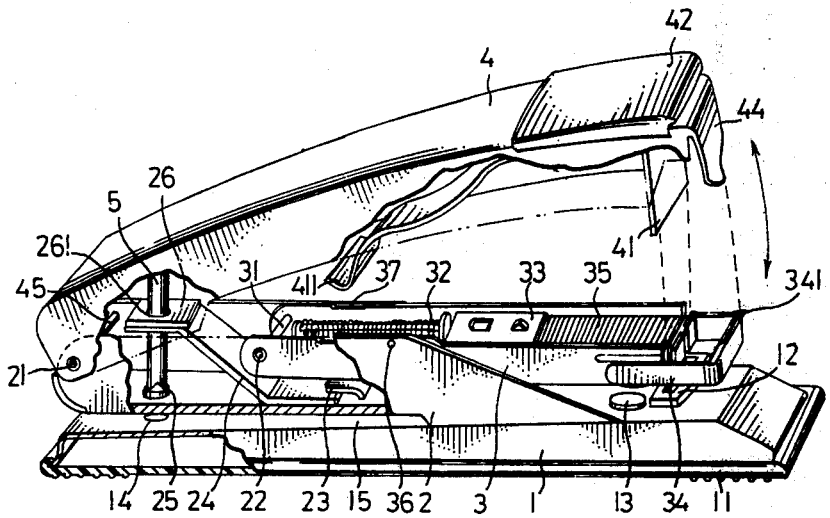
FIG. 1 depicts a preferred embodiment of the multi-purpose stapler of the present invention in a perspective view with a partial cut away view of the inside construction to show the stapling blade in its stand-by position ready for stapling.

Referring to FIG. 1, the multi-purpose stapler of the present invention comprises a base 1, a supporting bracket 2, a staple magazine 3, a press handle and a staple remover assembly 4 and a hole punch 5.

The hollow space provided under base 1 serves to collect paper scraps resulting from punched holes. Under the base a plastic cover 11 is snapped thereon. A staple clinching die 12 is disposed near the front end of the base. Supporting bracket 2 is fixed on base 1 with rivet 13. At the rear end of bracket 2, a pair of pivot holes 21 are provided to pivotally join the press handle assembly with a pin 45. At the middle section of bracket 2, another pair of pivot holes 22 are provided to pivotally join the staple magazine 3 with a pin 31. The staple magazine 3 is retained in a horizontal position by a detent 36 on the bracket. In the rear section of staple magazine 3, a coil spring 32 is provided to force a staple pusher 33 against a row of staples 35, so that the front most staple will be positioned at the forward end of the magazine. Directly above the front most staple is a stapling blade 41, with both the stapling blade and front most staple being aligned directly above clinching die 12. These arrangements are conventional and no further discussion is warranted.

Figure 2:
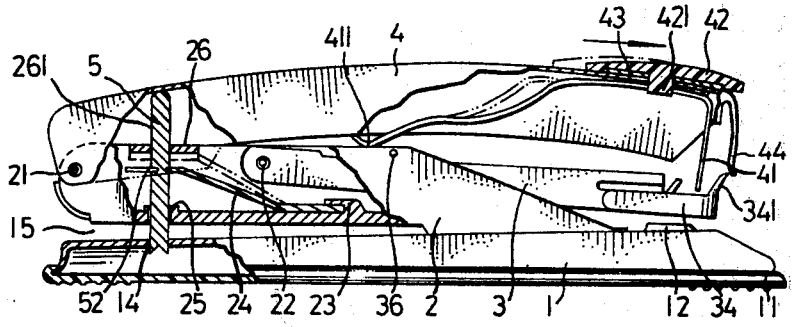
FIG. 2 is a side elevation of the same embodiment with a partial cut away to show the stapling blade shifted forward to a suspension position, and the press handle compressed in the direction of the base, thereby, depicting both the hole punch and the staple remover in their respective actuated positions.

One of the features of the present invention is the capability of shifting the stapling blade between a rearward and a forward position. Referring to FIG. 2, a slot 43 is provided in the front section of the press handle 4. A plastic button 42 slidable on the handle is connected to a horizontal extension of the stapling blade by rivet 421 which passes through slot 43 on handle 4 to render the blade shiftable between a rearward and a forward position. The horizontal portion of the stapling blade which is preferably made of elastic material extends diagonally rearwardly and downwardly to engage the bracket, thus forming a spring 411 which returns handle 4 back to its rest position after completion of an operation. In FIG. 2, blade 41 is shifted forward to a position, wherein it is no longer aligned with the front most staple and clinching die 12, so that when handle 4 is pressed down, the stapler will not function.

A bearing plate 26 is provided at the rear section of the bracket 2. The upper end of a punch rod 5 extends through hole 261 of the bearing plate 26. At the middle section of punch rod 5, a circular groove 52 is provided to receive a fork like end of a spring strap 24, the other end of which is secured in retainer 23 of bracket 2. The lower end of the punch rod 5 is sharp and extends through hole 25 formed at the rear bottom of the bracket 2. The punch rod 5, guided by the holes 261 and 25, is moved down by pressing the handle 4 and is returned by spring strap 24. At the rear section of base 1, directly under the punch rod 5, a punch receiving aperture 14 is provided which is aligned with the lower sharp end of punch rod 5. Clearance 15 between base 1 and bracket 2 is for inserting paper to be punched. In FIG. 2, the lower end of punch rod 5 is engaged with punch receiving aperture 14.

A U-shaped member 34 is welded to the front end of staple magazine 3. At the middle section of member 34, a pincers tip 341 protrudes upward to form the lower jaw of the staple remover assembly. Member 44 forms the upper jaw of the staple remover assembly and is formed by bending down the front most portion of press handle 4. The pair of jaws is operable as a staple remover. In FIG. 2, tip 341 and member 44 are shown in the staple removal position.

The multi-purpose stapler as described above, with stapler, hole punch and staple remover provided on a common base, is extremely compact and convenient to use.

The above embodiment is given only for purposes of illustration and not by way of limitation and modification will become evident to those skilled in the art which will fall within the scope of the attached claims.

I claim:

1. A multi-purpose stapler comprising a hole punching means, a staple removing means and a stapling means mounted on a common base wherein A. the stapling means comprises the base having a punch receiving aperture provided at one end and a clinching die provided at the other end thereof, a supporting bracket having a front portion fixedly mounted on said base, a middle portion, and a rear portion having a hole in the bottom thereof and spaced from said base to provide for insertion of material to be punched, a press handle pivotally mounted to said rear portion of said supporting bracket having a longitudinal slot in a front portion thereof, a button slidably mounted on said press handle and having an integral protrusion which extends into said slot, a staple magazine pivotally mounted to said middle portion of said supporting bracket, a stapling blade having a vertical staple driving portion and rearwardly extending horizontal portion secured to said integral protrusion of said button whereby upon movement of said button to a rearward position the stapling blade is aligned with a foremost staple positioned in the staple magazine above the clinching die, thereby upon depression of said press handle a staple is driven out of said magazine into material placed over said clinching die and clinched by said clinching die, and upon movement of said button to a forward position the stapling blade, when in its forward position is not aligned with a staple in said magazine and therefore is incapable of driving said staple into said material, and;

B. wherein said staple removing means comprises an upper jaw depending from the forward end of said press handle, and a lower jaw comprising a U-shaped member fixedly mounted to the front end of said staple magazine with a mid-section of said U-shaped member extending upwardly in opposing relationship to said upper jaw whereby the upper and lower jaws are adapted to cooperatively engage and remove a staple from the material upon the application of pressure to the press handle in the direction of the base when said button is in said forward position and C. wherein said hole punching means comprises a bearing plate fixedly mounted to said rear portion of said support bracket and having a hole which is vertically aligned with said hole in the bottom of the rear portion of the support bracket and with said punch receiving aperture in said base, a spring strap the forward end of which is secured to said support bracket and the other end of which has a fork-like configuration and, a punch rod slidably received in the holes of said bearing plate and support bracket, and having a circular groove adapted to receive the fork-like configuration of said spring strap, said punch rod being slidably engaged by said press handle whereby the lower end of the punch rod passes through the punch receiving aperture upon the application of pressure to the press handle to punch a hole in material inserted into said space between the base and said rear portion of said support bracket.

2. A multi-purpose stapler according to claim 1, wherein said horizontal portion of said stapling blade has a resilient portion extending rearwardly and diagonally downward to engage said middle portion of said support bracket to restore said press handle to its original position after an operation.

3. The multi-purpose stapler according to claim 1, wherein said base is hollow and a cover is disengageably mounted on a bottom portion of said base to collect paper scrap resulting from said hole punching.

* * * * *